US006942612B2

(12) United States Patent
Caspary et al.

(10) Patent No.: US 6,942,612 B2
(45) Date of Patent: Sep. 13, 2005

(54) HOOD WITH A DOUBLE WALL FOR A THERMOTHERAPY DEVICE

(75) Inventors: René-Christian Caspary, Lübeck (DE); Eckhard Riggert, Ratekau (DE)

(73) Assignee: Dräger Medical AG & Co. KGaA, Lübeck (DE)

( * ) Notice: Subject to any disclaimer, the term of this patent is extended or adjusted under 35 U.S.C. 154(b) by 0 days.

(21) Appl. No.: 10/802,293

(22) Filed: Mar. 17, 2004

(65) Prior Publication Data

US 2005/0004422 A1 Jan. 6, 2005

(30) Foreign Application Priority Data

Jul. 2, 2003 (DE) ..... 103 32 787

(51) Int. Cl.[7] ..... A61G 11/00
(52) U.S. Cl. ..... 600/22
(58) Field of Search ..... 600/21, 22; 128/897, 128/205.15

(56) References Cited

U.S. PATENT DOCUMENTS

| | | | | |
|---|---|---|---|---|
| 1,387,486 A | * | 8/1921 | Gray | 312/116 |
| 3,470,866 A | * | 10/1969 | Gittelson | 600/22 |
| 4,321,913 A | * | 3/1982 | Maluta et al. | 600/22 |
| 4,750,474 A | | 6/1988 | Dukhan et al. | |
| 4,936,824 A | * | 6/1990 | Koch et al. | 600/22 |
| 5,944,651 A | | 8/1999 | Koch | |
| 6,048,304 A | | 4/2000 | Koch | |
| 6,293,902 B1 | * | 9/2001 | Hundertmark et al. | 600/22 |
| 6,409,653 B1 | | 6/2002 | Koch et al. | |
| 6,443,885 B1 | | 9/2002 | Schüler | |
| 6,491,621 B1 | | 12/2002 | Dykes | |
| 6,513,195 B2 | | 2/2003 | Haase et al. | |
| 6,554,471 B2 | | 4/2003 | Aval et al. | |
| 6,616,599 B2 | | 9/2003 | Koch | |
| 6,653,605 B2 | | 11/2003 | Kneuer | |

FOREIGN PATENT DOCUMENTS

DE 36 16 359 A1 11/1986

* cited by examiner

*Primary Examiner*—Samuel G. Gilbert
(74) *Attorney, Agent, or Firm*—McGlew and Tuttle, P.C.

(57) ABSTRACT

A hood with a double wall portion or wall adapter for a thermotherapy device. The wall adapter works with the hood in such thermotherapy devices to lower that part of the body heat of the premature or newborn infant lost due to radiation to the cooler hood. The construction avoids inter alia problems relating to water of condensation being formed, which may drop off. The double wall portion or wall adapter is arranged on the outside of a hood portion of the hood (1). The wall adapter (2) is fastened to the hood part (1) from the outside in a simple manner. A connection structure (5) provides for connection or locking of the wall adapter (2) at the hood (1). A seal (3) extends around the wall element of the wall adapter (2) to enclose an intermediate space between the wall adapter and (2) and the hood (1).

16 Claims, 4 Drawing Sheets

HOOD WITH A DOUBLE WALL FOR A THERMOTHERAPY DEVICE

CROSS REFERENCE TO RELATED APPLICATIONS

This application claims the benefit of priority under 35 U.S.C. §119 of German patent application DE 103 32 787 filed Jul. 2, 2003 the entire contents of which are incorporated herein by reference.

FIELD OF THE INVENTION

The present invention pertains to a hood with a double wall for a thermotherapy device.

BACKGROUND OF THE INVENTION

The problem usually occurring in thermotherapy devices for premature or newborn infants with a hood, which is designed, e.g., as an incubator hood or as a hood of a hybrid, i.e., a combination of an open incubator and an incubator, is that part of the body heat of the premature or newborn infant is lost due to radiation to the cooler hood and, moreover, water of condensation is formed, which may drop off. To overcome this drawback, U.S. Pat. No. 6,491,621 B1 describes an incubator in which the door or the lateral surfaces are provided with an inner double wall for receiving a hot air flow between the incubator and the inner double wall. The inner double wall can be folded away or removed. DE 36 16 359 A1 discloses an incubator that is designed as a double-walled cylindrical section, so that heated and humidified air can also be fed in here through the area between the two walls to form a heated air curtain.

The problem occurring in the known cases of hoods for incubators with a double wall is that moisture and microorganisms accumulate between the double wall and the hood. Moreover, the formation of water of condensation hinders the to of the premature or newborn infant in the interior of the thermotherapy device. Cleaning is therefore necessary at regular intervals, for which the hood must be opened and the double wall must be pivoted off or removed. This means additional work for the personnel, on the one hand, and, on the other hand, an adverse effect on the patient.

SUMMARY OF THE INVENTION

The object of the present invention is to provide a hood with a double wall with which the slightest possible adverse effect on the patient located therein is avoided.

The object is accomplished by the hood according to the present invention with a double wall.

In the hood according to the present invention with a double wall for a thermotherapy device, the double wall extends essentially in parallel to at least one limiting surface of the hood. This may be, e.g., the upper limiting surface. As an alternative or in addition the lateral surfaces or a flap located at the hood may be the location of the portion that combines to form the double wall. The double wall is arranged on the hood in such a way that it can be detached or pivoted off from the outside. No water of condensation will thus accumulate in the intermediate space between the double wall and the hood, and the intermediate space and interior surface is readily accessible from the outside, e.g., for cleaning purposes, without the patient, who may be a premature or newborn infant located in the thermotherapy device, being adversely affected.

In an advantageous embodiment, the double wall has a peripheral seal, which isolates a volume in the intermediate space, between the surfaces of the double wall portion and the hood surface, against the environment. Heat insulation is thus achieved, which leads to an increase in the temperature of the hood of the thermotherapy device, regardless of whether other heating means, e.g., a hot air flow, are provided.

The volume in the intermediate space, between the surfaces of the double wall portion and the hood surface, is advantageously filled with a material that possesses good insulating properties. Air, i.e., regular ambient air, or a suitable insulating material, may be considered as preferable for use for this purpose.

The suitable insulating materials are, e.g., expanded materials with pores, in which air is enclosed, as well as materials that are also transparent.

In another preferred embodiment, the double wall is locked in a position at a predetermined distance at the hood. The distance is, e.g., between 6 mm and 15 mm and preferably between 10 mm and 11 mm in the narrowest area between the double wall portion surface and the hood surface. The locking structure or means for locking the double wall portion at the hood, is e.g., a pushing means, which extends through an elastic bush in the double wall portion and widens the bush in its end position in the area of a hole in the hood. Such a pushing locking structure is used especially as a locking means against the displacement and falling out of the double wall portion during the opening of the hood of the thermotherapy device.

An exemplary embodiment of the hood according to the present invention will be explained on the basis of the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
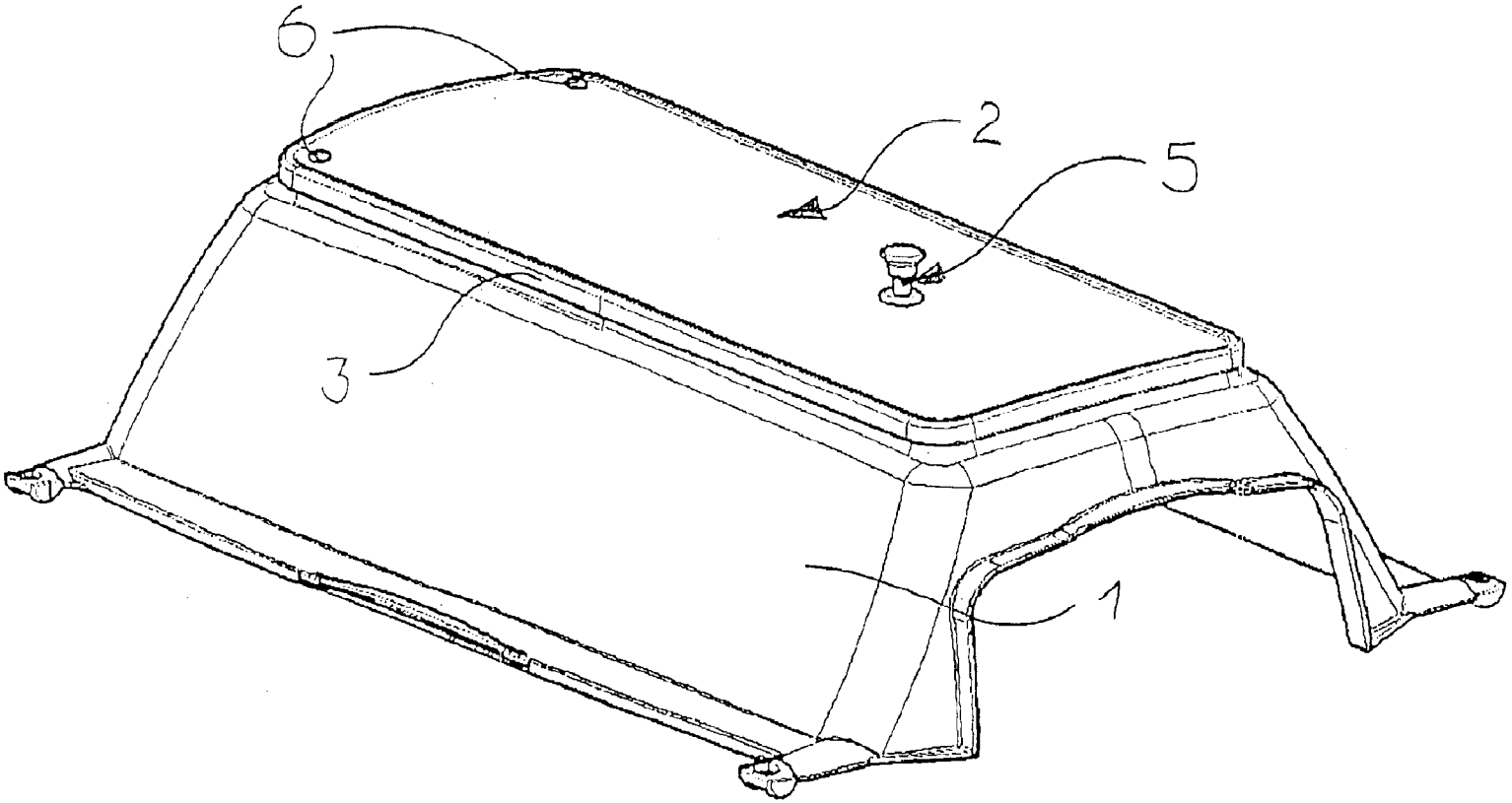
FIG. 1 is a perspective top view in an oblique direction from the-top toward a hood according to the present invention with a double wall.

Referring to the drawings in particular, FIG. 1 shows a perspective view of a hood 1 according to the present invention with a double wall portion (outer wall part or single to double wall adapter) 2 in an oblique direction from the top. The corresponding thermotherapy device is not shown. The thermotherapy device (or incubator) may use a bed surface and related features as described in U.S. Pat. No. 6,554,471, the disclosure of which is hereby incorporated by reference and may use thermotherapy device features and control features as described in U.S. Pat. Nos. 6,653,605; 6,616,599; 6,554,471; 6,443,885; 6,409,653; 6,048,304; 5,944,651, the disclosure of each of these U.S. patents is hereby incorporated by reference, and U.S. patent application Ser. No. 09/850,340, the disclosure of which is hereby incorporated by reference.

The double wall portion 2 is fastened to the hood 1 by a pushing means as part of a locking structure (means for locking) or connection means 5. Two positioning elements 6 are additionally used to position the double wall portion 2 at the hood 1.

The double wall 2 portion comprises a wall element 20 (e.g., formed of a transparent plastic) and a peripheral seal (e.g., formed of an elastomeric material) 3. Connecting the double wall portion 2 to the hood 1 (i.e., by locking structure or means for locking 5) results in the peripheral seal 3 engaging the hood 1 so that an intermediate space is enclosed by the double wall portion 2 and the hood 1 (see FIG. 3).

Figure 2:
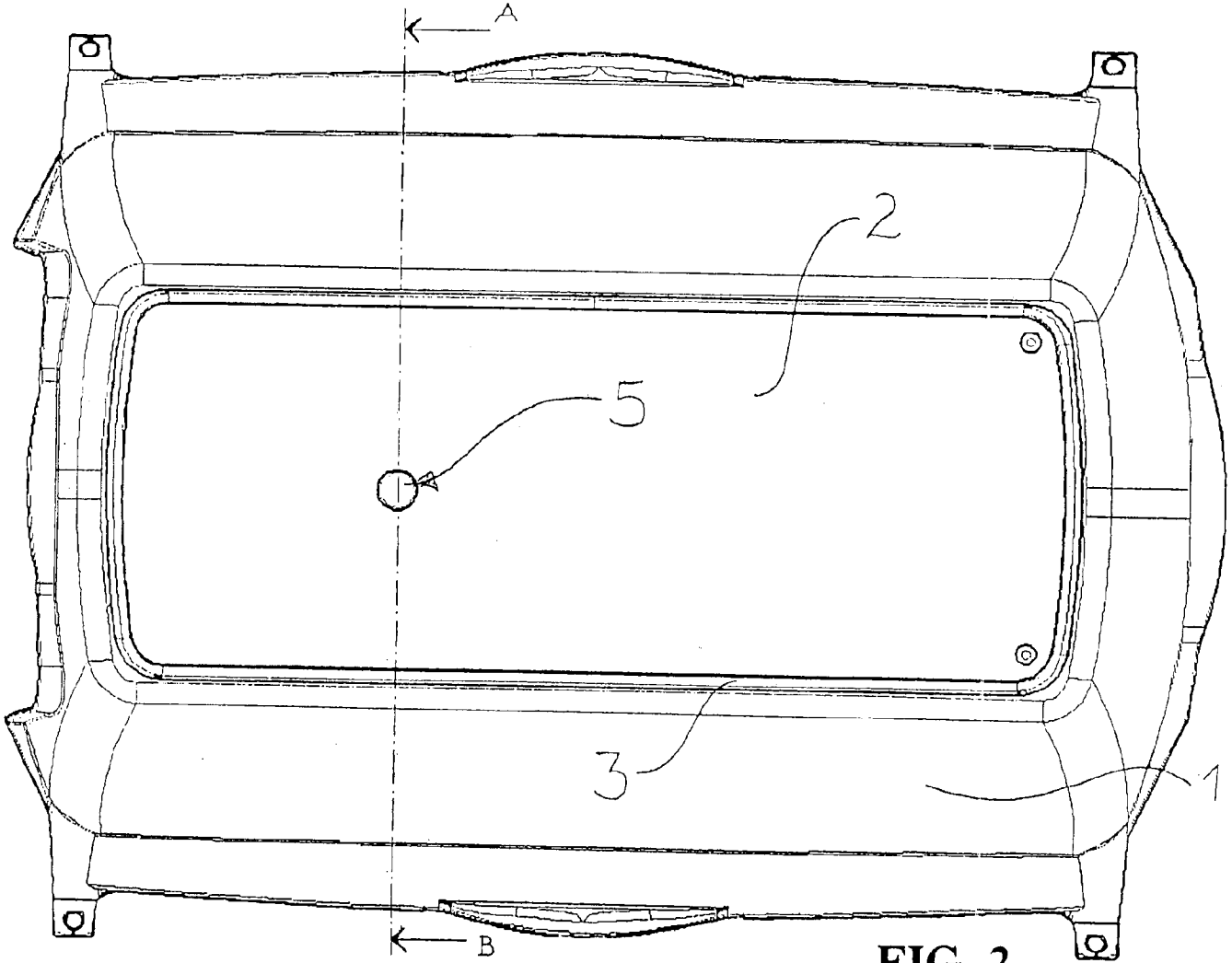
FIG. 2 is a top view at right angles from the top to the hood in FIG. 1.

FIG. 2 shows the hood 1 from FIG. 1 at right angles-from the top. The same reference numbers are used for identical components. The double wall portion 2 is disposed at the top of the hood 1.

Figure 3:
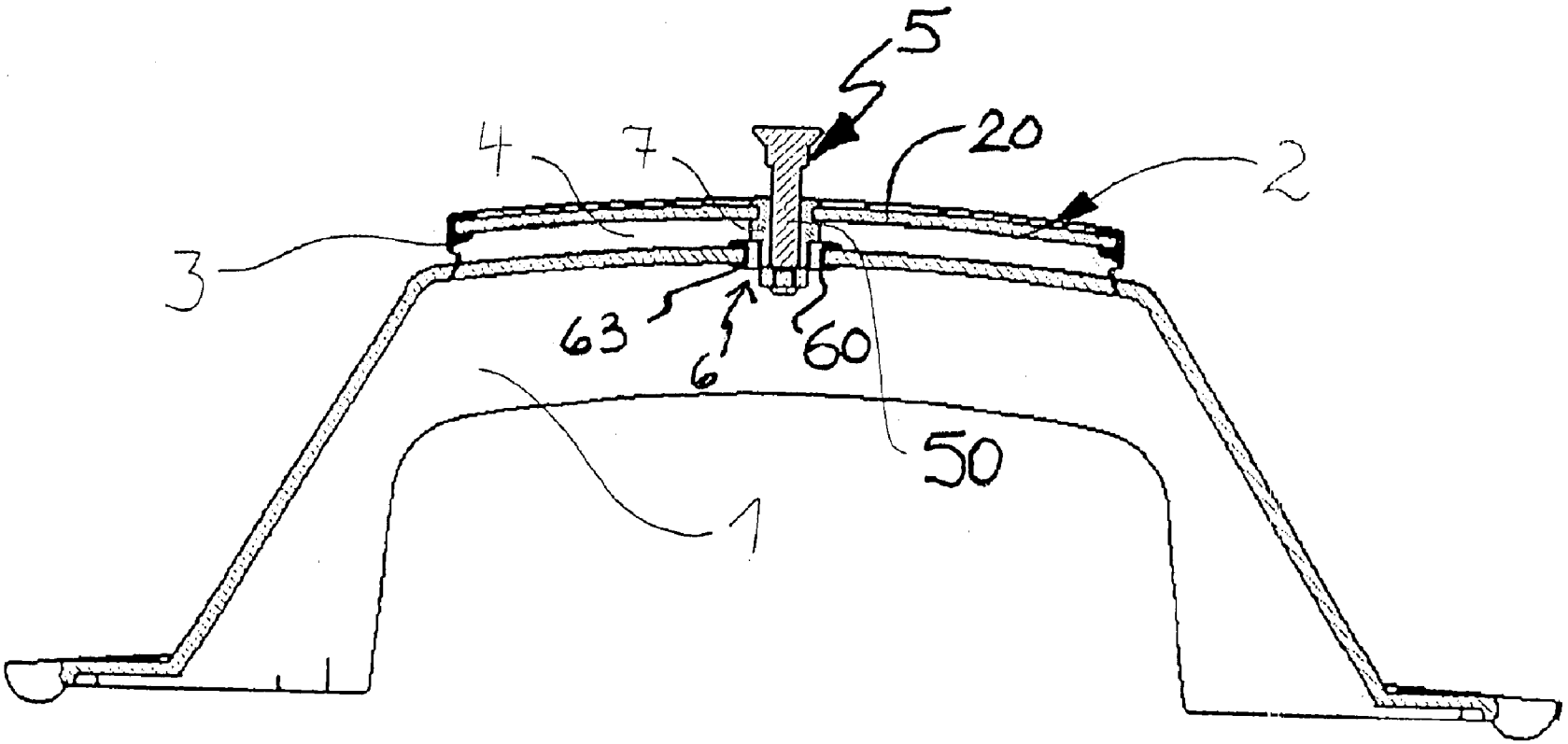
FIG. 3 is a cross section along line A–B in FIG. 2 showing an embodiment with air as the insulation.

FIG. 3 shows a cross section through the hood 1 with a double wall portion 2, shown with the section taken along line A–B in FIG. 2. The volume 4 enclosed in the intermediate space between the double wall portion or wall adapter 2 and the hood 1 can be recognized. In the embodiment of FIG. 3, air is provided as the insulation in the volume 4 enclosed in the intermediate space between the double wall portion 2 and the hood 1. Furthermore, an elastic bush 7 of the locking structure or means for locking 5 is shown. The elastic bush 7 accommodates the pushing means 50 of the locking structure or means for locking 5. The elastic bush 7 engages a receiving portion 6 of the hood 2. The receiving portion 6 may be provided in an opening in the hood with an annular receiving element 60 and an annular sealing and connecting element (e.g., an elastomeric element) 63.

Figure 4:
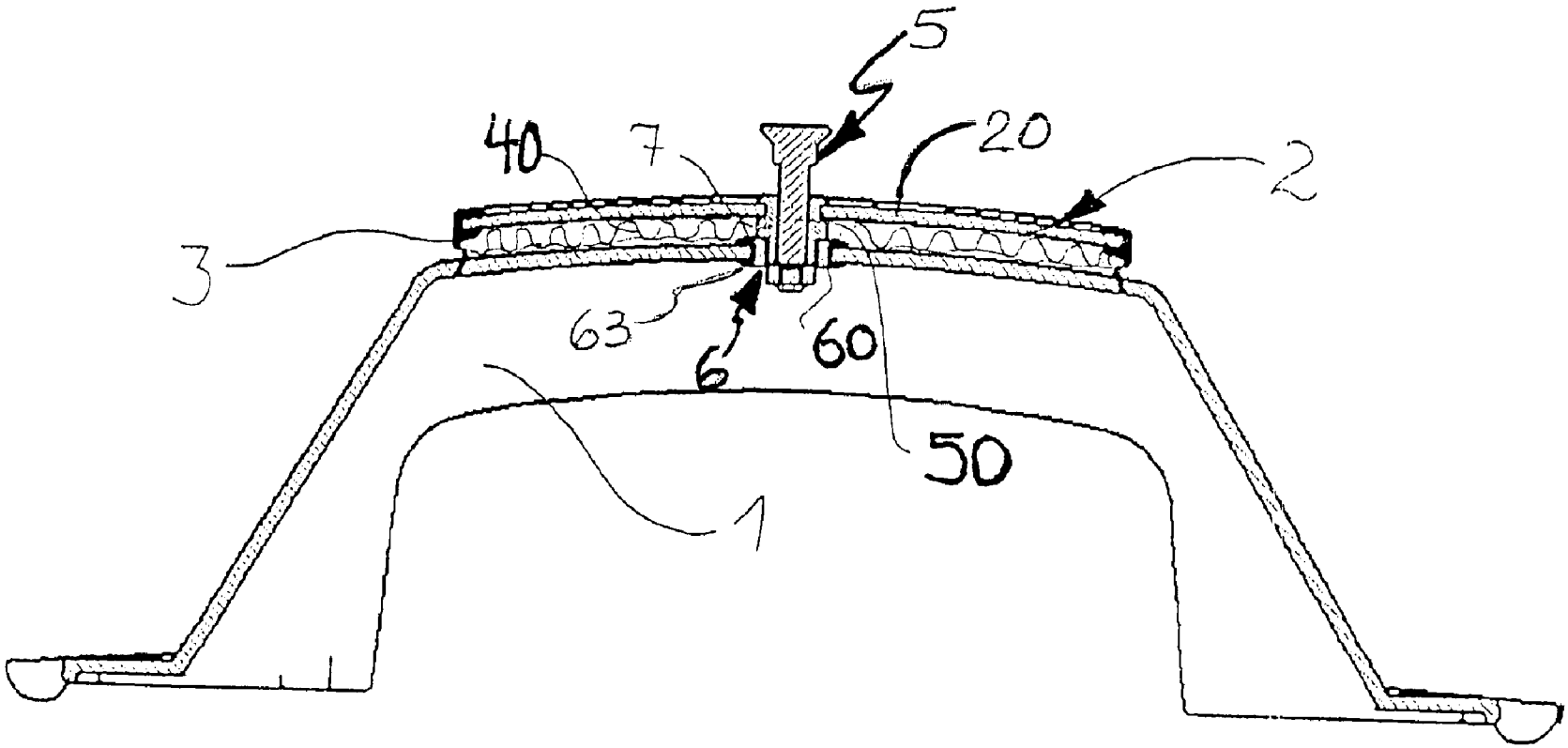
FIG. 4 is a cross section along line A–B in FIG. 2 showing an embodiment with a material and air as the insulation.

FIG. 4 shows a view similar to FIG. 3. Instead of air in the volume 4, the insulation in the embodiment of FIG. 4 is an expanded material 40 with pores, in which air is enclose. The material 40, is transparent.

In operation the double wall portion 2 is connected to the hood 1 via the locking structure or means for locking 5. The pushing means 50 of the locking structure or means for locking 5 is used to push the elastic bush 7 into the annular receiving element 60. With this connection and with a pushing action, the double wall portion 2 is connected to the hood 1 with the peripheral seal 3 engaging the hood 1 so that an intermediate space is enclosed by the double wall portion 2 and the hood 1 (see FIG. 3).

While specific embodiments of the invention have been shown and described in detail to illustrate the application of the principles of the invention, it will be understood that the invention may be embodied otherwise without departing from such principles.

What is claimed is:

1. A hood for a thermotherapy device, the hood comprising:

a hood portion with a hood limiting outer surface;

a double wall portion detachably or pivotably connected at an outside of said hood portion, said double wall portion having a surface that extends essentially in parallel to a portion of said limiting outer surface of said hood portion in a connected state to define a double wall with said portion of said limiting outer surface, said double wall portion surface having a peripheral edge;

a peripheral seal extending fully around said peripheral edge and having and opposite sealing side connecting to said limiting outer surface to isolate an intermediate volume in an intermediate space defined between said double wall portion surface and said limiting outer surface with respect to a surrounding environment and with respect to an interior side of the of hood limiting outer surface; and connection means for detachably or pivotably connecting said double wall portion to said hood portion for maintaining said double wall portion surface in said connected state and for detaching or pivoting said double wall portion surface from said hood portion to assume a pivoted or detached state with said surface of said double wall portion not extending in parallel to said limiting outer surface.

2. A hood in accordance with claim 1, wherein said double wall portion peripheral seal for isolating a volume in an intermediate space defined between said double wall portion and said hood limiting surface with respect to a surrounding environment is an elastomeric material.

3. A hood in accordance with claim 2, wherein said volume in the intermediate space contains an insulation.

4. A hood in accordance with claim 3, wherein air forms said insulation between the hood portion and the double wall portion.

5. A hood for a thermotherapy device, the hood comprising:

a hood portion with a hood limiting surface;

a double wall portion, detachably or pivotably connected at an outside of said hood portion, wherein said double wall portion extends essentially in parallel to said limiting surface of said hood portion, wherein said double wall portion has a peripheral seal for isolatating a volume in an intermediate space defined between said double wall portion and said hood limiting surface with respect to a surrounding environment, wherein said volume in the intermediate space contains an insulation, wherein air and an insulating material form said insulation, said insulating material having pores for enclosing the air between the hood portion and the double wall portion.

6. A hood in accordance with claim 5, wherein the insulating material is transparent.

7. A hood in accordance with claim 1, wherein said commecting means comprises a locking means for locking said double wall portion at said hood portion, at a predetermijned distance from said hood portion.

8. A thermotherapy device hood, comprising:

a hood part with a single wall hood limiting surface facing an exterior environment;

a wall adapter with a single wall element having a peripheral edge and a connection means for detachably or pivotably connecting said wall adapter at an outside of said hood part with said wall adapter extending essentially in parallel to said limiting surface of said hood part to form a double wall;

a peripheral seal connecting said peripheral edge to said hood limiting surface in a connected state of said wall adapter, said wall element covering a region of said hood limiting surface in a connected state with an interior space isolated from the exterior environment by said parallel extending wall adapter and said peripheral seal with a remaining region of said hood limiting surface remaining as a single wall not covered by said wall adapter.

9. A hood in accordance with claim 8, wherein said wall adapter peripheral seal for isolating a volume in an intermediate space defined between said wall adapter and said hood limiting surface with respect to a surrounding environment is an elastomeric material.

10. A hood in accordance with claim 8, wherein said volume in the intermediate space contains insulation.

11. A hood in accordance with claim 10, wherein said instruction between the hood portion and the wall adapter comprises air.

12. A hood in accordance with claim 10, wherein said insulation between the hood portion and the wall adapter comprises air and an insulating material having pores for enclosing the air between the hood portion and the wall adapter.

13. A hood in accordance with claim 12, wherein the insulating material is transparent.

14. A hood in accordance with claim 8, wherein said connecting means comprises a locking means for locking said wall adapter at said hood part, at a predetermined distance from said hood part.

15. A method for easy removal of accumulates in a double walled thermotherapy device without causing adverse effect on a patient, the method comprising the steps of:

Providing a patient bed;

providing a hood comprising an inner wall, said hood and said patient bed cooperating to provide a thermotherapy region;

providing an outer wall with a detachably or pivotably connection means for engagement with said hood, said inner wall, and said outer wall defining an intermediate space between said inner wall and said outer wall;

providing thermotherapy in said hood in said thermotherapy region;

removing said outer wall via said connection means to clean moisture, microorganisms or to view the patient only through said inner wall; and providing a peripheral seal around said outer wall to isolate said intermediate space for ambient environment.

16. A method according to claim 15 further comprising the step of:

providing an insulating material taken from materials such as air, air enclosing pores, transparent insulator or other material in said intermediate space.

* * * * *